United States Patent [19]

Rheeder et al.

[11] Patent Number: 4,573,564

[45] Date of Patent: Mar. 4, 1986

[54] TROLLEY LOCKING DEVICE

[75] Inventors: Frederik R. L. Rheeder; Deon Dixon, both of Randburg, South Africa

[73] Assignee: Trailmor [Proprietary] Limited, Johannesburg, South Africa

[21] Appl. No.: 602,181

[22] Filed: Apr. 19, 1984

[30] Foreign Application Priority Data

May 10, 1983 [ZA] South Africa ..... 83/3322

[51] Int. Cl.[4] ..... G07F 17/10

[52] U.S. Cl. ..... 194/250; 194/905

[58] Field of Search ..... 70/DIG. 41; 194/78, 194/84, 17, 79, 64, 55, 57, 1 E

[56] References Cited

U.S. PATENT DOCUMENTS 604,255 5/1898 Luke ..... 194/1 E 4,474,282 10/1984 Lenander ..... 194/4 D

*Primary Examiner*—Stanley H. Tollberg

*Attorney, Agent, or Firm*—Bucknam and Archer

[57] ABSTRACT

A trolley locking device of the type comprising two co-operating parts, one of which is attached to each of two trolleys and whereof one part is a lock unit and the other is a key unit. The key and lock units are adapted to be releasable locked together with a coin or token is introduced into a slot in the side of the lock unit which enables the key to move a plug inside the lock unit axially to free the plug for rotation between two terminal positions thereof. The key engages the coin or token which acts as the medium for creating axial movement of the plug which is biased against such movement. Co-operating formations on the plug and lock unit prevent rotation of the plug unless moved axially against the bias applied to the plug. The coin or token can only be removed while the key and lock unit are engaged and the key can only be removed from the lock unit when a coin or token is present in the latter.

9 Claims, 4 Drawing Figures

TROLLEY LOCKING DEVICE

FIELD OF THE INVENTION

This invention relates to a trolley locking device which is adapted to operate on a basically known principle and the object of which is to encourage users of trolleys, once a trolley has served its immediate purpose, to return it to a depot or other station.

It is well known that supermarket and luggage trolleys tend to be left where the last user unloaded goods carried by same. This, in fact, leads to such trolleys being wheeled over long distances, and often being lost by the owner on a temporary or permanent basis.

BACKGROUND TO THE INVENTION

In order to alleviate this problem there has been manufactured a trolley locking device comprising members which are permanently associated with each of the trolleys of a group thereof and wherein one part of the locking device co-operates with a part of a locking device associated with another trolley in order to lock the two trolleys together in a releasable manner.

In order to release the trolleys a coin must be introduced into one of the parts of the device and the trolleys can then be separated. The idea is that in order to recover the coin the trolley must be returned to a depot or the like so that the part of the locking device on the trolley can be inter-engaged with a co-operating part on another trolley to again lock the two trolleys together. Once the two parts of the locking device are locked together, the coin can be recovered.

Existing locking devices of this general nature are generally costly and of fairly complicated construction. Also, in at least some cases, one part of the device has to be rigidly attached to a supermarket trolley and, due to the general design of such trolleys, it must be attached in a position in which it tends to damage refrigerators or other fixtures in supermarkets, for example.

It is the object of this invention to provide a device of the above general type which can be inexpensively manufactured, is simple to operate, and wherein both parts can be suspended from a height on a supermarket trolley above that which tends to interfere with fixtures in a supermarket thereby lessening the possibility of damage to such fixtures.

SUMMARY OF THE INVENTION

In accordance with this invention there is provided a trolley locking device comprising a lock unit having a tubular body housing an axially movable and rotatable plug in the interior thereof the plug being biased towards engagement with rotation inhibiting formations which, in use, retain the plug in one of at least a first and a second selected angular position in the absence of axial movement of the plug; a key member co-operable with a key-way associated with the plug and whereby a rotation force can be applied to the plug, the plug having a transverse coin or token receiving slot and a recess or passage opposite the key, an access slot in the tubular body positioned for alignment with the coin or token receiving slot in said first angular position of the plug but for at least partial misalignment in said second angular position of the plug, the plug being movable axially to free the plug for rotation only when a coin or token is present in the coin or token receiving slot by reason of engagement of the key with the coin or token and the key being removable from the said lock unit with the plug in said second angular position with a coin or token in the coin or token receiving slot but being non-removable with the plug in the said first angular position of the plug.

Further features of the invention provide for the tubular body of the lock unit to have a sidewall of circular cross-section with end-wall members secured in each end thereof; for one end wall defining member to accommodate one end of an axially extending anchorage member; for the opposite end wall defining member to define an access key-way for receiving said key; for the key to be of non-circular cross-section at its head region so as to co-operate, to apply said rotational force, with a complementary formation in said movable plug; and for the key to have an operating handle biased, in the engaged position, away from the lock unit.

BRIEF DESCRIPTION OF THE DRAWINGS

In order that the invention may be more fully understood one embodiment thereof will now be described with reference to the accompanying drawings in which.

DETAILED DESCRIPTION WITH REFERENCE TO THE DRAWINGS

Figure 1:
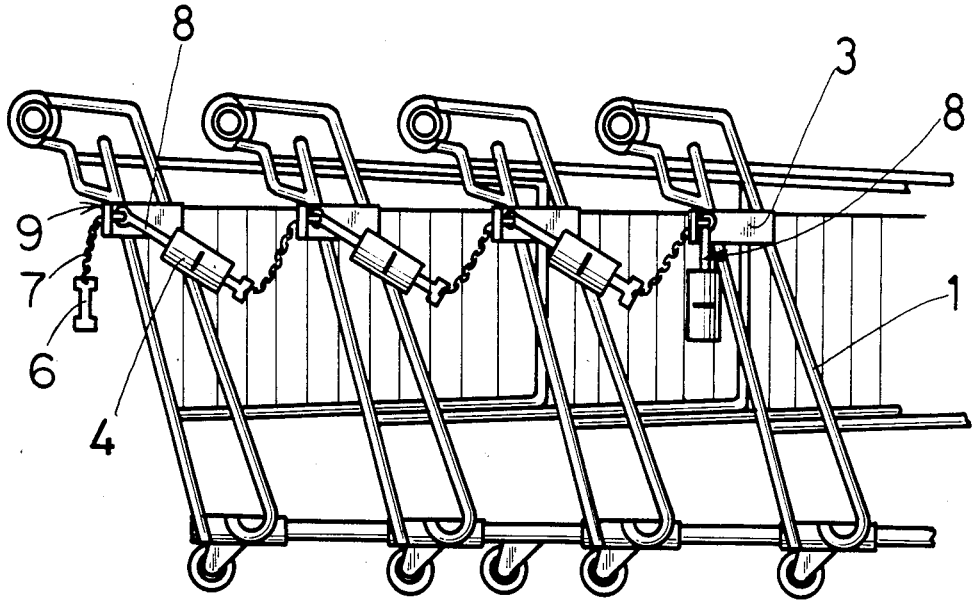
FIG. 1 illustrates, in perspective view, parts of two interengaged supermarket trolleys locked together by means of a device according to this invention.

In this embodiment of the invention the device is adapted to operate on basically known general principles by locking a trolley 1 to another similar trolley 2 in a horizontally stacked and interengaged condition.

To this end each of the trolleys is provided, in an identical position, with a bracket 3 secured thereto and a lock unit 4 carried by a rod 8 is allowed to hang from an anchorage 5 fixed relative to the bracket. Also fixed to each bracket is a key 6 attached by means of a flexible element such as a chain 7 to the bracket in each case.

The chain and depending lock unit, the latter being rigid with the rod 8 whereby it is suspended, are dimensioned such that it is impossible, without removing the key from the chain, to engage that particular key 6 with the lock unit associated with the same trolley.

However, as illustrated in FIG. 1, the lock unit 4 of one trolley can be engaged with a key 6 associated with a trolley immediately in front of it and, in order to ensure that a lock unit is employed to project forwardly somewhat to interengage with its key of the other trolley, the bracket is provided with a plate 9 extending outwardly at right angles to the bracket 3 so that the lock unit cannot be moved rearwardly in order to create a confusing situation in which it would be locked to the key unit of the trolley behind it. Obviously any other arrangement may be employed to ensure that the correct key unit is engaged with the correct lock unit.

As a result of the articulated nature of the connection whereby the lock unit is attached to the bracket, the lock unit, if it engages a fixture or the like in a supermarket, will not damage same to any appreciable extent and, ordinary resilient or shock absorbing means could be provided on the lock unit or the fixture, as may be required, in order to prevent damage.

Figure 2:
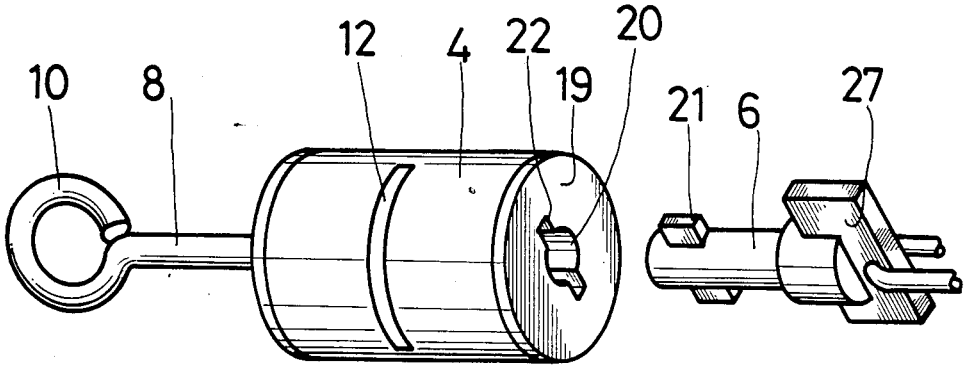
FIG. 2 illustrates, in isometric view, a locking unit and key in exploded relationship relative to each other.

The lock unit and key will now be described in further detail with particular reference to FIGS. 2 to 4.

In this embodiment of the invention the locking device, as indicated above, comprises the locking unit 4 and a key 6 for co-operation therewith.

The rigid axially extending rod 8 is provided with an eye formation 10 at its free end whereby it can be attached to the bracket 3 by means of the anchorage 5.

The lock unit has a circular cylindrical side wall 11 with an access slot 12 extending therethrough and made to accommodate the required size of coin at right angles to the axis of the side wall. Clearly a circular or non-circular token could replace such a coin.

The access slot communicates with a coin receiving slot 13 in an axially movable and rotatable plug 14 located co-axially within the cylindrical side wall. The plug is urged, by means of a compression spring 15, in a direction away from an end wall 16 of the lock unit, being the end wall to which the axially extending rigid rod 8 is attached. The attachment can be by any suitable means.

The plug member has a hole therethrough and, indeed, adjacent the coin receiving slot 13 on the side of the spring 15, has a hole 17 only somewhat smaller in diameter than a coin which it is to receive in use. A freely movable disc 18 serves to transmit the biasing force of the spring 15 to the plug 14.

At the opposite end of the cylindrical side wall 11 is an end piece 19 having an axially extending access keyway 20 for accommodating the key 6. In this embodiment of the invention the key 6 has a head formation defined simply by a pair of diametrically opposed outwardly projecting key members 21 and the passage way 20 has complementary key ways 22 to accommodate same.

The plug 14 has a similar shaped passage way or hole 23 which can, in one angular orientation of the plug relative to the end piece 19 (the second angular position defined above), be axially aligned so as to permit axial entry and withdrawal of the key 6. FIG. 4 illustrates the axial passage and hole in the plug member 14 in the latter condition and with the key removed, whilst FIG. 3 illustrates the plug member rotated through 90° and with the key held captively in position by virtue of the key members 21 being 90° offset from the grooves 22 in the axially extending passageway. The latter condition corresponds to said first angular position of the plug mentioned above. In the two terminal angular positions of the plug member just described, formations 24 associated with the end piece 19 co-operate the recesses 25 in the plug member to inhibit rotation of the plug within the cylindrical body.

The recesses 25 are of different depths so that the plug member will adopt different axial positions in the two terminal angular positions just described, although this is not a necessity of the invention so long as the access slot is at least sufficiently offset from the coin receiving slot to prevent removal of the coin.

Figure 3:
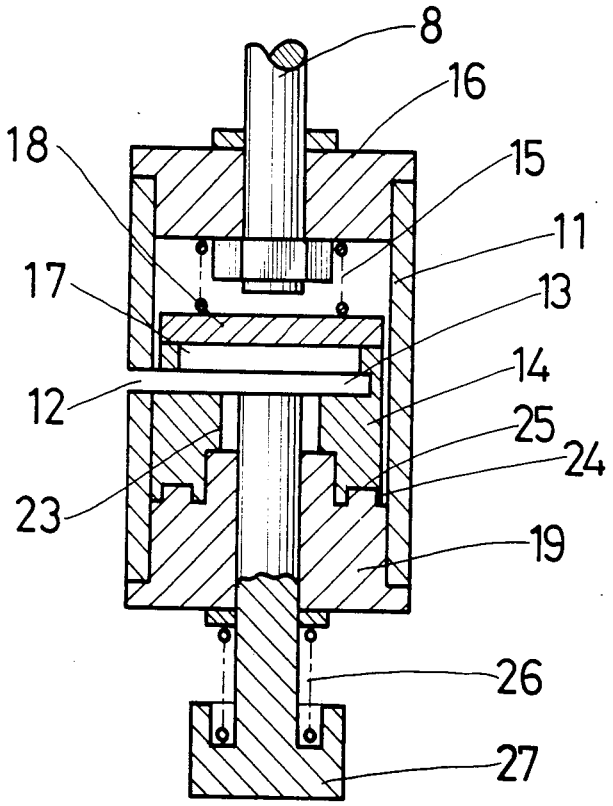
FIG. 3 illustrates, in longitudinal sectional elevation, the locking unit with the key in the installed position and the coin or token receiving slot open.
Figure 4:
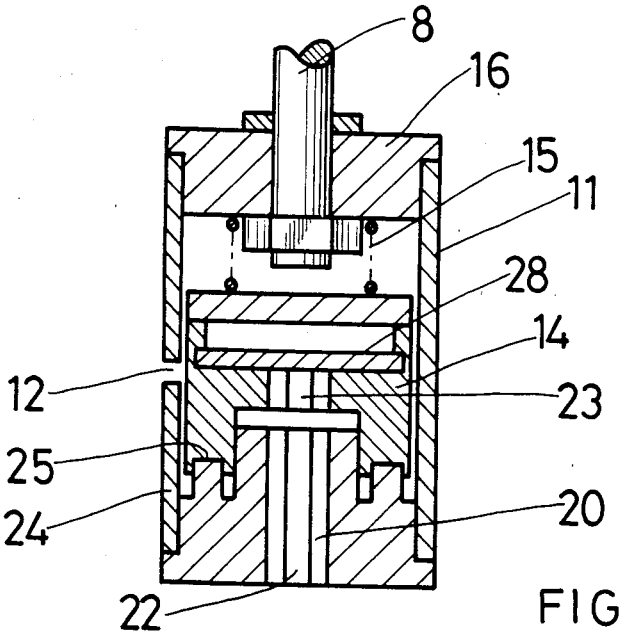
FIG. 4 illustrates, also in longitudinal sectional elevation, the locking unit, but with the key removed and the slot closed and accommodating a coin.

The arrangement of the coin receiving slot 13 in the plug member is such that, as shown in FIG. 3, when the key is in a position in which it is held captively in the lock unit, the coin receiving slot aligns with the access slot 12 through the cylindrical side wall 11. In this position, if no coin is present in the slot 13, the key can be pushed inwardly against the biasing of a retaining spring 26 extending between the end piece 19 and an operating handle 27 of the key (see FIG. 3) and the key will simply move into the hole 17 on the opposite side of the coin receiving slot 13 and will, upon further axial movement, simply depress the disc 18 if pushed far enough. However, no axial movement of the plug can take place and, accordingly, no angular movement thereof in consequence of the interengagement of the formations 24 with the recesses 25 in the plug.

When a coin or token is introduced through the access slot 12 in the cylindrical side wall 11 and into the coin receiving slot 13 in the plug 14 the key can be pushed axially in order to engage the coin and, in consequence thereof move the plug member against the biasing of the spring 15 by reason of the periphery of the coin engaging in the coin receiving slot 13. Once the plug 14 has been moved axially to a sufficient extent it can be rotated through 90° (or indeed any other chosen angular movement) until the other set of recesses engage with the formations 24. In this position the grooves 22 of the access keyway 20 align with the corresponding portions of the hole 23 in the plug member and the key can be slid out. The coin, indicated by numeral 28 in FIG. 4 is, in this position, locked inside the locking unit and is displaced axially from the position of the access slot in the sidewall 12 and also angularly so that the access slot through the side wall 12 only aligns, if at all, partially with the coin receiving slot 13 in the plug 14.

Accordingly, until such time as the plug is rotated to its former position, the coin cannot be removed and a key is required in order to rotate the plug member to a position in which the coin can be recovered.

It will be understood that, in use, the device described above can be employed for locking supermarket or luggage trolleys together and a trolley can only be released from associated trolleys by inserting the required coin and operating the key to release it from the lock unit as above described. When a person wishes to recover the "deposit" of the coin the trolley must be returned to a station or the like where a key will be available in order to recover the coin by introducing the key axially into the access keyway 22 with its head into the hole 23 in the plug and to push the plug member through the medium of the coin 28 axially and enable it to be rotated back through the 90° to a position in which the coin receiving slot 13 is opposite the access slot 12 in the side wall 11. The coin can simply then be allowed to roll out of the slot by manipulating the lock unit.

It will be understood that numerous variations may be made to the abovedescribed embodiment of the invention without departing from the scope hereof. In particular the nature and configuration of the plug may be varied widely and the interengagement of recesses and formations in order to retain the plug in its two angular positions can be varied as required.

The shape and configuration of the housing can be changed according to requirements and the lock unit can be suspended by means other than the rigid rod 8. Indeed, if required, the lock unit could be permanently fixed to the side of a trolley provided it does not interfere with any fixtures in the area in which it is to be used. Also, such a unit can be mounted extremely easily to a supermarket trolley without any special fitting requirements provided that the chain is sufficiently long to enable the locking unit of one trolley to be engaged by a key unit of an adjacent trolley in order to give effect to the required locking and unlocking movement.

The invention therefore provides an extremely simple yet highly effective locking device for supermarket and luggage trolleys or the like.

What we claim as new and desire to secure by Letters Patent is:

1. A trolley locking device comprising a lock unit (4) and a key member (6) releasably connectable thereto, the lock unit having a tubular body provided with rotation-inhibiting formations (24) therein and housing an axially movable and rotatable plug (14) in the interior thereof, the plug being biased towards engagement with the rotation inhibiting formations which in use retain the plug in one of at least a first and a second selected angular position in the absence of axial movement of the plug, the plug has a key-way (20), the key member being co-operable with said key-way whereby a rotational force is applied from the key member to the plug, the plug having a transverse coin receiving slot (13) and a recess (17) opposite the key on the side of the slot remote from the key-way in the plug, an access slot (12) in the tubular body positioned for alignment with the coin receiving slot in the plug in said first angular position of the plug relative to the tubular body to allow introduction or removal of a coin (28) in and from the slot, the access slot (12) being at least partially misaligned with the coin receiving slot in said second angular position of the plug, relative to the tubular body, the plug being movable axially by engagement of the key member to free the plug for rotation only when a coin is located in the coin receiving slot whereby axial movement of the key member is transmitted to the plug and said plug becomes rotatable by disengagement thereof from the rotation inhibiting formations, the key member being removable from the said lock unit with the plug in said second angular position with a coin in the coin receiving slot but being non-removable with the plug in the said first angular position of the plug, the recess opposite the key member serving to receive part of the key member in the absence of a coin being present in the coin or token receiving slot.

2. A trolley locking device as claimed in claim 1 in which the tubular body of the lock unit has a sidewall (11) of circular cross-section with end wall defining members secured to each end thereof.

3. A trolley locking device as claimed in claim 1, in which an axially extending anchorage member (5) is carried by an end wall to the tubular body.

4. A trolley locking device as claimed in claim 2, in which the key member is a key and the key-way is axially orientated and an end wall has a co-axial access key-way for said key.

5. A trolley locking device as claimed in claim 4, in which the key has a non-circular head for applying, by co-operation with said co-operating key way in the plug, a rotational force to the plug.

6. A trolley locking device as claimed in claim 1, in which the plug is spring-biased towards said formations by a spring bearing on a freely moveable disc (18) which, in turn, acts on the plug.

7. A trolley locking device as claimed in claim 6 in which the plug has a hole therethrough and the key, in the absence of a coin being present in said receiving slot, can move the disc without movement of the plug.

8. A trolley locking device as claimed in claim 7, wherein the rotation inhibiting formations which co-operate in said first and second angular positions are axially spaced apart.

9. A trolley locking device as claimed in claim 8, in which the said first and second angular positions of the plug in the lock unit are angularly offset from each other by about 90°.

* * * * *